US006002293A

United States Patent [19]

Brokaw

[11] Patent Number: 6,002,293

[45] Date of Patent: Dec. 14, 1999

[54] HIGH TRANSCONDUCTANCE VOLTAGE REFERENCE CELL

[75] Inventor: A. Paul Brokaw, Burlington, Mass.

[73] Assignee: Analog Devices, Inc., Norwood, Mass.

[21] Appl. No.: 09/047,123

[22] Filed: Mar. 24, 1998

[51] Int. Cl.[6] ..... G05F 1/10

[52] U.S. Cl. ..... 327/540; 327/538; 327/539; 323/313

[58] Field of Search ..... 327/538, 539, 327/540; 323/313

[56] References Cited

U.S. PATENT DOCUMENTS

| | | | |
|---|---|---|---|
| 4,475,103 | 10/1984 | Brokaw et al. | 340/501 |
| 4,816,742 | 3/1989 | van de Plassche | 323/314 |
| 4,958,122 | 9/1990 | Main | 323/315 |
| 5,095,274 | 3/1992 | Brokaw | 324/414 |
| 5,404,096 | 4/1995 | Thiel | 323/312 |
| 5,517,103 | 5/1996 | Ng et al. | 323/315 |
| 5,576,616 | 11/1996 | Ridgers | 323/314 |
| 5,602,466 | 2/1997 | Edwards | 323/313 |
| 5,621,308 | 4/1997 | Kadanka et al. | 323/315 |
| 5,900,772 | 5/1999 | Somerville et al. | 327/539 |

OTHER PUBLICATIONS

A. Paul Brokaw, "A Simple Three–Terminal IC Bandgap Reference", *IEEE Journal of Solid–State Circuits*, vol. SC–9, No. 6, Dec. 1974, pp. 30b–35b.

*Primary Examiner*—Terry D. Cunningham
*Attorney, Agent, or Firm*—Koppel & Jacobs

[57] ABSTRACT

A high transconductance voltage reference cell produces a large change in output current for a very small change in input voltage near a settable equilibrium point, which can be made equal to two bandgap voltages, or to non-integer multiples of the bandgap voltage without the use of a resistive divider. A first and second pair of bipolar transistors, at least one of which have unequal emitter areas, are arranged in a crossed-quad configuration, with a first resistor interposed between one of the first pair and second pair transistors and a second resistor interposed between one of the second pairs' emitters and a common point. For input voltages below the equilibrium point, most of the current through the cell flows down one side of the quad. The voltage drop across the first resistor increases with input voltage, and causes the cell current to be abruptly switched from one side of the quad to the other at the equilibrium point. This large change in current induced by a small change in input voltage provides the cell's high transconductance. The cell can be made to exhibit a lower $g_m$ or some hysteresis by adjusting the relationship between the resistor values. The equilibrium point is dictated by the emitter area ratios between the quad's transistors, which cause the cell to carry a proportional-to-absolute-temperature (PTAT) current at the equilibrium point. The PTAT current can be made to compensate the quad to provide a temperature invariant equilibrium point.

23 Claims, 6 Drawing Sheets

| R1, R2 | LOOP GAIN @ EQUILIBRIUM |
|---|---|
| R1=R2 | 1 |
| R1<R2 | <1 |
| R1>R2 | >1 |

HIGH TRANSCONDUCTANCE VOLTAGE REFERENCE CELL

BACKGROUND OF THE INVENTION

1. Field of the Invention

This invention relates to the field of bandgap voltage reference cells, and particularly to bandgap reference cells having a high transconductance.

2. Description of the Related Art

A basic bandgap voltage reference cell is shown in FIG. 1. Two bipolar transistors $Q_a$ and $Q_b$ are driven by the output of an operational amplifier 14, with their collectors connected to the op amp's non-inverting and inverting inputs, respectively, and to a supply voltage V+ through respective resistors 16 and 18. A resistor $R_a$ is connected between the transistors' respective emitters, and a "tail" resistor $R_b$ is connected between the emitter of $Q_b$ and circuit common.

$Q_a$ is fabricated with an emitter area larger than that of $Q_b$ (by a ratio of 8-to-1 in FIG. 1). The op amp adjusts the transistors' base voltage until the voltages at its inverting and non-inverting inputs are equal. This occurs when the two collector currents match, which in this example happens when the emitter current densities are in the ratio of 8-to-1. This arrangement produces a voltage across $R_b$ that is proportional-to-absolute temperature (PTAT), which can be used to compensate the complementary-to-absolute-voltage (CTAT) characteristic of the base-emitter voltage of $Q_b$. Setting OUT equal to the bandgap voltage of silicon provides the proper compensation, and thereby produces a temperature invariant output voltage.

The transconductance $g_m$ of the circuit of FIG. 1 is defined as the change in the difference in the transistors' collector currents divided by the change in their base-emitter voltage. Because the difference in collector currents cannot exceed the change in current through $R_b$, the transconductance is capped at $1/R_b$, but because a perturbation causes both collector currents to change in the same direction, the maximum attainable $g_m$ is actually less than $1/R_b$. This bandgap reference cell and its characteristics are discussed in detail in A. Paul Brokaw's "A Simple Three-Terminal IC Bandgap Reference", IEEE Journal of Solid-State Circuits, Vol. SC-9, No. 6(1974).

Another bandgap reference cell is shown in FIG. 2, made from two transistors pairs connected in a "crossed-quad" configuration. A first pair of transistors $Q_c$ and $Q_d$ are connected in series with a second pair of transistors $Q_e$ and $Q_f$, respectively, with the bases of $Q_e$ and $Q_f$ connected to the collectors of $Q_f$ and $Q_e$, respectively. Transistors $Q_c$ and $Q_d$ have unequal emitter areas, as do transistors $Q_e$ and $Q_f$. A resistor $R_c$ is connected between the emitters of $Q_e$ and $Q_f$, and a tail resistor $R_d$ is connected between the emitter of $Q_f$ and circuit common. The collectors of $Q_c$ and $Q_d$ are connected to the inputs of an amplifier 20. The amplifier's output drives a pass transistor $Q_f$ to produce a regulated output OUT, which is fed back to $Q_c$'s and $Q_d$'s common bases. A PTAT voltage appears at the junction between $R_c$ and $R_d$; when the resistors are properly chosen, the PTAT voltage compensates for the base-emitter voltages of $Q_f$ and $Q_d$ to produce a temperature invariant voltage equal to twice the bandgap voltage at OUT. Achieving an output voltage greater that is a non-integer multiple of the bandgap voltage is typically provided by adding a voltage divider 22 between OUT and the common base connection, as shown in FIG. 2. The divider imposes a voltage drop between the output and the common base connection, but assuming that amplifier 20 has sufficient gain, it will continue to balance the collector currents and the output will be stabilized at a higher voltage.

The transconductance of the circuit of FIG. 2 is somewhat better than that of FIG. 1. When the cell is at equilibrium (i.e., when the collector currents are balanced), a PTAT current flows in $R_c$ which is determined solely by the emitter area ratios and the value of $R_c$; i.e., essentially independent of the current on the right side of the crossed-quad. With the left side current fixed, when the cell's output is disturbed, nearly all of the resulting change in current goes through the right side of the cell ($Q_d$ and $Q_f$), with the current through the left side ($Q_c$ and $Q_e$) essentially unchanged. Thus, all of the change in current goes through $R_d$, and the cell's transconductance closely approaches $1/R_d$.

Because of the relatively low transconductance of the bandgap cells in FIGS. 1 and 2, the voltage applied to the common bases (of $Q_a$ and $Q_b$ in FIG. 1; $Q_c$ and $Q_d$ in FIG. 2) must depart substantially from the voltage which balances the currents if a large difference in collector currents is needed. This is usually accommodated by connecting a high gain amplifier across the collectors, to provide a differential-to-single ended conversion as well as the voltage gain necessary to return to equilibrium; this function is represented by amplifier 20 FIG. 2.

Disadvantages are found in the circuits of FIGS. 1 and 2, particularly when low power consumption is important, as with a battery-powered regulator. The power consumed by amplifier 20 will hasten the discharge of a battery used to provide the circuit's supply voltage, as will the energy lost in resistive divider 22. Use of a resistive divider 22 is also troublesome if the regulator is employed, for example, as a battery charger, with a battery to be charged connected to OUT. When the regulator is inactive or unable to provide the necessary charging current, the presence of a divider actually provides a discharge path for the battery, shortening its life.

SUMMARY OF THE INVENTION

A novel voltage reference cell is presented which has a very high transconductance, producing a large change in output current for a very small change in input voltage near a settable equilibrium point and thereby dispensing with the need for a high gain amplifier. The cell can be configured to set the equilibrium point equal to two bandgap voltages, or to non-integer multiples of the bandgap voltage without the use of a resistive divider. Eliminating the amplifier and resistive divider components of prior art designs reduces the reference cell's component count, as well as its power consumption.

The core of the voltage reference cell is made from a first and second pair of bipolar transistors nominally arranged in a crossed-quad configuration, with the bases of the first pair connected together at an input node. At least one of the transistor pairs have unequal emitter areas. In contrast with a standard crossed-quad configuration, however, a first resistor is interposed between one of the first pair transistors and the base of one of the second pair transistors, at least one of which has a larger emitter area than its pair, with a second resistor connected to the emitter of the second pair transistor on the opposite side of quad from the first resistor.

A voltage applied to the input node causes a current to flow through the cell from the input node to the common point. For input voltages below an "equilibrium" point, the unequal emitter areas force the voltages at the bases of the two second pair transistors to be unequal, which causes most of the current to flow down one side of the quad. As the input voltage increases toward the equilibrium point, the voltage drop across the first resistor increases and the inequality between the second pair transistors' base voltages gets smaller. The relationship between the two base voltages reverses as the equilibrium point is exceeded, causing the cell current to be abruptly "switched" from one side of the quad to the other.

The cell's output is taken at the collectors of the first pair of transistors, with nearly all of the cell current switching from one collector to the other at the equilibrium voltage. In prior art cells, a change in current was largely reflected on only one side of the cell. Here, a change in cell current at the equilibrium point causes the current on the two sides to move in opposite directions, with the movement equal to the nearly the entire cell current. This large change in current induced by a very small change in input voltage provides the cell a very high transconductance.

A maximum transconductance is obtained when the first and second resistors are equal. However, by simply making the value of one of the resistors greater than the other, additional options are presented to a designer: making the second resistor value greater than the first provides a somewhat lower $g_m$, which might be needed to improve loop stability, for example. Making the first resistor greater than the second creates a loop gain greater than one, which introduces some hysteresis around the equilibrium point that may be useful in regenerative applications such as a comparator.

The equilibrium point is established at a voltage dictated by the emitter area ratios between the quad's transistors. When the input voltage is such that the sum of the voltage drops across the resistors equals the voltage set by the emitter area ratios, the cell current switches sides. The cell thus carries a proportional-to-absolute-temperature (PTAT) current at the equilibrium point, which can be used to drive a pass transistor or an amplifier, for example. With the addition of a properly chosen tail resistor, the cell can produce an output voltage equal to two bandgap voltages.

The cell can also generate output voltages that are higher, non-integer multiples of the bandgap voltage without the use of a resistive divider. The tail resistor is split into two resistors, with the junction between them connected, via another resistor, to a transistor having its base connected to the input node. These components are arranged so that a temperature invariant current is delivered to the junction point, which offsets the equilibrium point to a higher, temperature stable voltage.

Further features and advantages of the invention will be apparent to those skilled in the art from the following detailed description, taken together with the accompanying drawings.

DETAILED DESCRIPTION OF THE INVENTION

Figure 1:
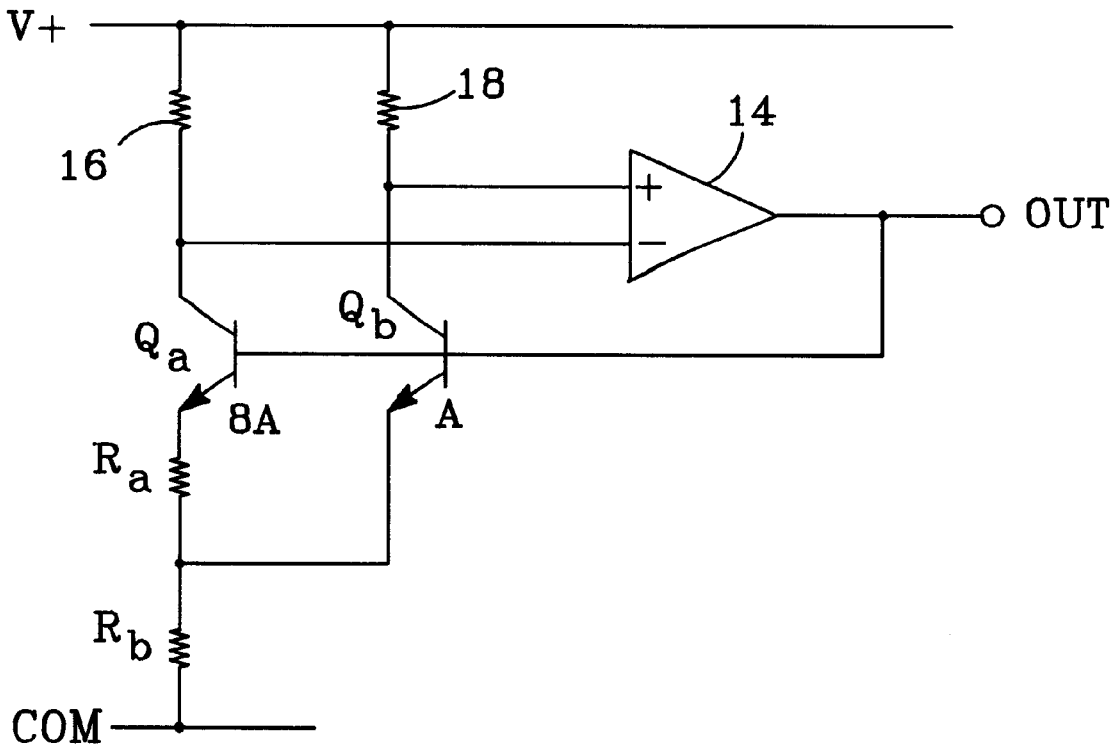
FIG.1 (Prior Art)
FIGS. 1 and 2 are schematic diagrams of prior art bandgap voltage reference cells.
Figure 2:
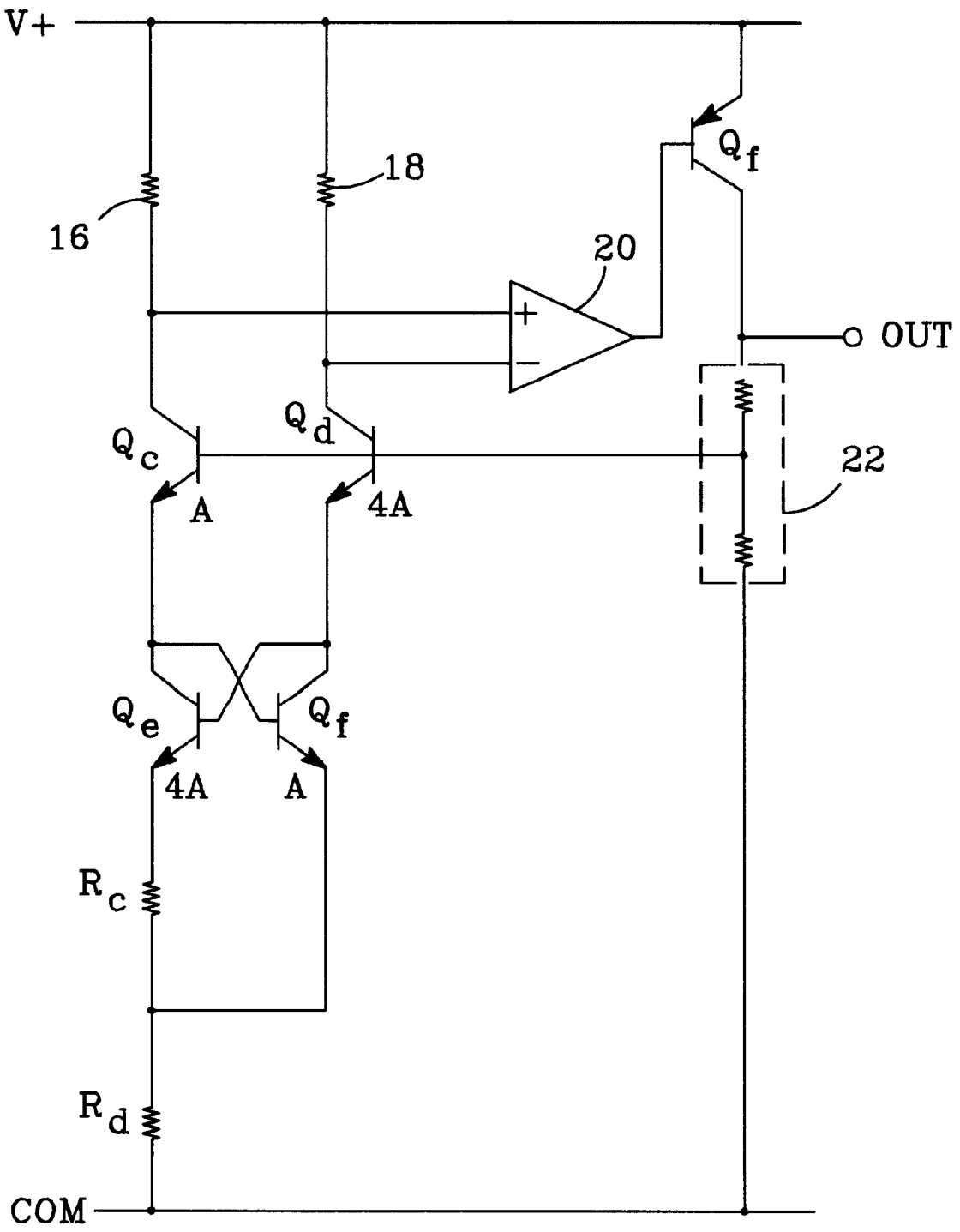
FIG.2 (Prior Art)
Figure 3:
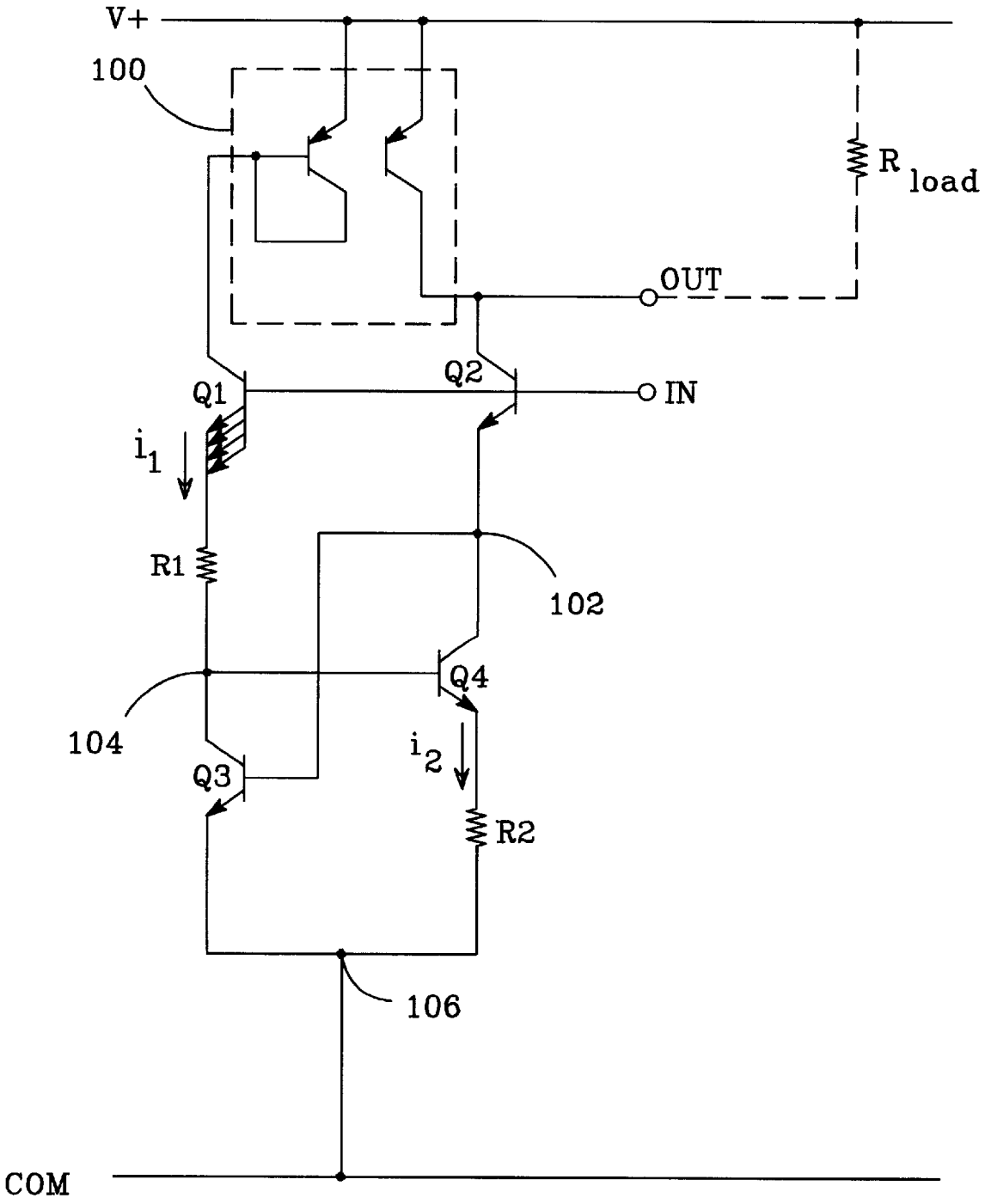
FIG. 3 is a schematic diagram of a high transconductance voltage reference cell per the present invention.

A high transconductance voltage reference cell per the present invention is shown in FIG. 3. The cell includes four bipolar transistors Q1–Q4 connected in a crossed-quad configuration. The bases of a first pair of transistors Q1 and Q2 are connected together and form an input node IN, and their respective collectors are connected to a current source 100, typically implemented with a current mirror, arranged to provide balanced currents to Q1 and Q2. A second pair of transistors Q3 and Q4 have their respective bases cross-coupled to each other's collectors, with Q3's base connected to Q4's collector at a node 102, and Q4's base connected to Q3's collector at a node 104. The transistors making up at least one of the pairs must have unequal emitter areas; in the exemplary circuit of FIG. 3, Q1 has an emitter area 4 times that of Q2.

The collectors of Q3 and Q4 are connected to the emitters of Q1 and Q2, respectively, with a resistor R1 interposed between the emitter of Q1 and node 104. Another resistor R2 is connected between the emitter of Q4 and a circuit common point 106, which is also connected to the emitter of Q3.

When an input voltage greater than two base-emitter voltages is applied at IN, the path from IN to common point 106 will be forward-biased and a "cell" current will flow between them. If the available current is small, the voltage drop across R1 and R2 must also be small, so that the distribution of cell current in transistors Q1–Q4 is controlled by their respective emitter areas. Due to its larger emitter area, Q1's base-emitter voltage ($V_{be1}$) is lower than that of Q2 ($V_{be2}$) at equal currents, which forces node 102 at the base of Q3 to be lower than node 104 at the base of Q4. This makes the voltage applied to Q4 higher than that applied to Q3, making the collector current of Q4 greater than that of Q3. The imbalance of these currents increases the voltage between nodes 102 and 104, which further unbalances the currents. As a result, the current in the two right hand transistors Q2 and Q4 rises to take most of the cell current, with the collector current of Q15 carrying little more than the base current of Q4. In this state, most of the cell current is delivered to the output terminal OUT, where it is connected to drive a load represented by a resistor $R_{load}$ which can be, for example, a pass transistor or an amplifier.

Summing the voltages between IN and common point 106 (and neglecting base currents):

$$V_{be3}+V_{be2}=V_{be1}+i_1R1+V_{be4}+i_2R2 \quad \text{(Eq. 1)}$$

where $V_{bex}$ refers to the base-emitter voltage of Qx and $i_y$ refers to the current in Ry.

As the available cell current increases with an increasing input voltage, so will the current in Q1. At some particular input voltage, the currents in Q1 and Q2 become equal. In this case (neglecting base currents), the current in Q1 is the same as the current in Q3, and the current in Q2 is the same as the current in Q4. With the same currents in differently sized transistors, $V_{be3}$ is given as follows:

$$V_{be3}=V_{be1}+(kT/q)ln4$$

where "4" is the ratio of emitter areas between Q1 and Q3. For similarly sized transistors Q2 and Q4, $V_{be2}$ and $V_{be4}$ will be nearly equal. Substituting these results into Equation (1) provide:

$$V_{be1}+(kT/q)ln4+V_{be4}=V_{be1}+i_1R1+V_{be4}+i_2R2$$

or:

$$(kT/q)ln4=i_1R1+i_2R2 \quad \text{(Eq. 2)}$$

Thus, when an input voltage is applied to IN so that the condition of Eq. 2 is met, the current in the left side of the cell (Q1 and Q3) will equal the current in the right side of the cell (Q2 and Q4). The input voltage which satisfies Eq. 2 is the cell's "equilibrium" voltage $V_{eq}$. For input voltages below $V_{eq}$, most of the cell current flows through Q2 and thereby pulls down on OUT, in the manner and for the reasons described above. However, when the input voltage exceeds $V_{eq}$, most of the cell current abruptly switches sides and flows through Q1 to the current source 100, causing it to carry away any current from Q2 and the drive to the load connected to OUT is reduced to zero.

At the equilibrium voltage, the current through Q1 is just enough to make the voltage drop across R1 equal Q1's (kT/q)ln 4 difference in $V_{be}$, which makes the voltages at nodes 104 and 102 equal. Above $V_{eq}$, the voltage drop across R1 is too large to permit balance, while below $V_{eq}$, the voltage drop is too small. When $i_1$R1 exceeds Q1's (kT/q)ln 4 difference in $V_{be}$, the relationship between nodes 104 and 102 reverses—node 104 becomes lower than node 102—causing most of the cell current to flow in Q1. Conversely, when the cell current is too low, node 102 is low with respect to node 104, so that most of the current flows through Q2.

This flip-flopping of nearly all of the current from one side of the cell to the other at the equilibrium voltage gives the novel reference cell a very high transconductance. Because the currents are balanced at only one voltage, the transconductance is theoretically infinite: an infinitely small change in input voltage causes all of the current to switch sides. The $g_m$ is actually limited by base currents, but it is nevertheless very high. The new cell functions much differently than older designs: as described above, as input node voltage increased, the current on one side of a prior art cell would remain at a fixed value determined by emitter area ratios, with changes in cell current forced to appear on the opposite side. This inherently limited the achievable Δi and thus the transconductance. The novel cell functions by having nearly all of the current flow on one side of the quad, increasing beyond the limit imposed by the emitter area ratios of the prior art all the way up to the equilibrium voltage, at which point nearly all the cell current switches to the other side. The transconductance offered by the present invention is in sharp contrast to the relatively low $g_m$ of the prior art cells discussed above, which were limited to no more than the reciprocal of their tail resistor value.

From Eq. 2, it is seen that at the equilibrium point, the cell current is PTAT. This PTAT current can be used to make or detect other kinds of bandgap and non-bandgap voltages or currents with, for example, a non-zero temperature coefficient.

Figure 4A:
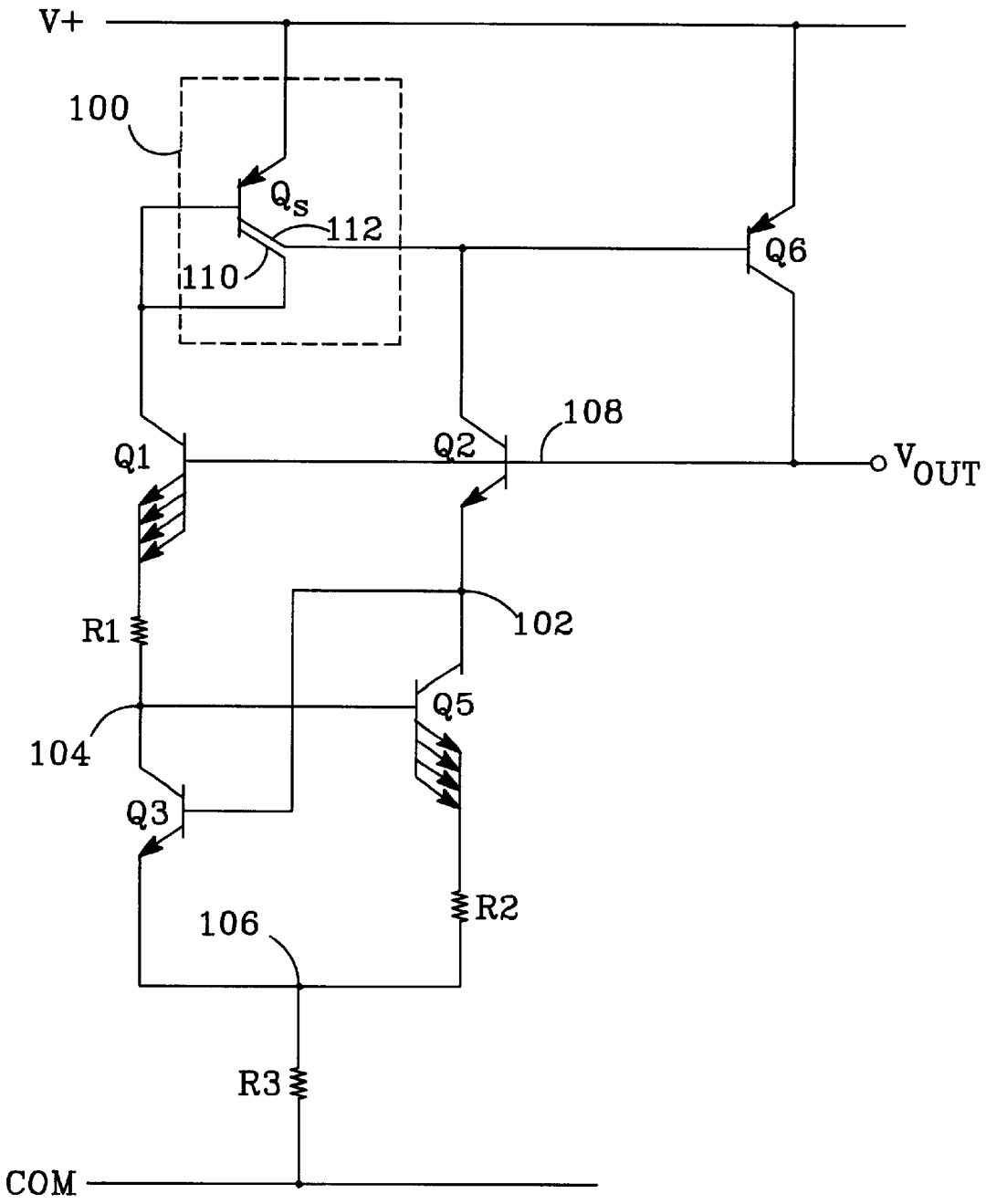
FIG. 4*a* is a schematic diagram of the novel cell having an equilibrium voltage equal to twice the bandgap voltage, and a table illustrating various obtainable loop gains.

An embodiment of the present invention for which the equilibrium voltage is equal to two bandgap voltages is shown in FIG. 4*a*. Though the invention only requires that one of the quad pairs have unequal emitter areas, it is convenient for both pairs to be similarly constituted, and the second transistor pair in FIG. 4*a* now consists of Q3 and a multi-emitter transistor Q5. $V_{be2}$ is now given by:

$$V_{be2}=V_{be5}+(kT/q)ln4$$

and the condition at which equilibrium is reached has been raised, and is given by:

$$(kT/q)ln16=i_1R1+i_2R2 \quad \text{(Eq. 3)}$$

A tail resistor R3 has been connected between node 106 and circuit common in order to provide the double bandgap voltage. If we make R1=R2=$R_{total}$, then:

$$R_{total}(i_1+i_2)=(kT/q)ln16,$$

and neglecting Q3's base current, $i_1+i_2$ is equal to $i_3$, the total current in R3, so that:

$$i_3=((kT/q)ln16)/R_{total} \quad \text{(Eq. 4)}$$

At the equilibrium point, the current in R3, as well as in the quad transistors, is PTAT. If R3 is properly chosen, the PTAT voltage at node 106 compensates the two base-emitter junction voltages of Q3 and Q2 and yields a double bandgap voltage at the base of Q2, identified as a node 108.

Current source 100 is preferably implemented with a dual collector transistor $Q_s$, connected as a current mirror: one of $Q_s$'s collectors 110 is connected to its base and to the collector of Q1; current through Q1 is mirrored to $Q_s$'s other collector 112, which is connected to the collector of Q2.

The base of a pass transistor Q6 is also connected to the collector of Q2. Q6 presents a relatively low impedance to Q2, and supplies whatever current it may need. Q6 together with the novel reference cell form a regulator, with Q6's collector serving as the regulator's output $V_{out}$. Q6's collector is connected to node 108 at the base of Q2.

The total current available to pull down on Q6's base is determined by the voltage across R3, which rises with $V_{out}$. This results in a "fold-back" V/I output characteristic. When the cell current exceeds the value given by Eq. 4, the circuit abruptly swings through its equilibrium condition, with the current that was flowing through the Q2/Q5 side of the quad now flowing through the Q1/Q3 side. The Q1 current is mirrored to its collector 112, reducing the drive to Q6 to near zero. Since the loop is closed to node 108 from the output of Q6, the output current will remain high as $V_{out}$ approaches the equilibrium point, and then abruptly drops to near zero as the equilibrium voltage is reached. If the equilibrium voltage has been arranged to be at twice the bandgap voltage as described above, the point at which the output current drops to zero is made temperature stable.

Because the transconductance of the new cell is so high, the high gain amplifier required in the prior art designs discussed above can be eliminated. Output pass transistor Q6 can be driven directly and still provide relatively good regulation. Eliminating the amplifier lowers the regulator's power consumption, as well as its component count.

Essential to the operation of the invention is the way in which the relationship between the voltages at nodes 102 and 104 reverses as the input node voltage increases. The resistors and the larger emitter transistors must be placed to insure this functioning. If the first transistor pair has an unequal emitter ratio, R1 must be placed in series with the transistor having the larger emitter. The smaller emitter transistor will have a larger $V_{be}$, making the node below its emitter lower than the node below R1 for lower input voltages. The voltage drop across R1, however, forces the relationship between the nodes to reverse when it carries a particular current—i.e, the cell current at the equilibrium voltage.

Similarly, if only the second transistor pair have an unequal emitter ratio, R2 should be placed in series with the transistor having the larger emitter. The larger emitter causes the transistor's collector to be pulled down harder than its pair is, unbalancing the voltages at their bases. The larger transistor's $V_{be}$ is reduced as the current through R2 increases, however, increasing the voltage of the node at its collector, with the relationship between the base voltages reversing at the equilibrium voltage.

If both pairs have unequal emitter ratios, the larger emitter transistors should be placed on opposite sides of the quad, as shown in FIG. 4*a*. R1 and R2 should also be placed on opposite sides of the quad.

The cell's transconductance is highest when R1=R2, which, because it is in a closed loop, provides a loop gain that reaches exactly +1 at the equilibrium point. Making R2 greater than R1 lowers the cell's $g_m$ and reduces the loop gain to less than +1, diminishing the abruptness with which the cell current switches from one side to the other. This might be done when a more controlled $g_m$ is desired—to frequency stabilize a closed loop system, for example.

Making R1 greater than R2 makes the loop gain greater than +1. Here, there is no point at which the currents are equally distributed. For this condition, the current will flow on the right side below and even at the equilibrium point. However, as input node 108 continues to rise, the current will abruptly switch to the other side, where it will stay until node 108 falls below the equilibrium point by some finite amount. This would be useful in regenerative applications; for example, in using the cell to provide a comparator with hysteresis.

Thus, as illustrated in the table shown in FIG. 4*a*, the invention can provide a very high $g_m$ (though with poor loop stability), a moderately high $g_m$ in a better controlled loop, or a $g_m$ providing a loop gain >1, useful for regenerative applications, by simply adjusting the respective values of R1 and R2.

Figure 4B:
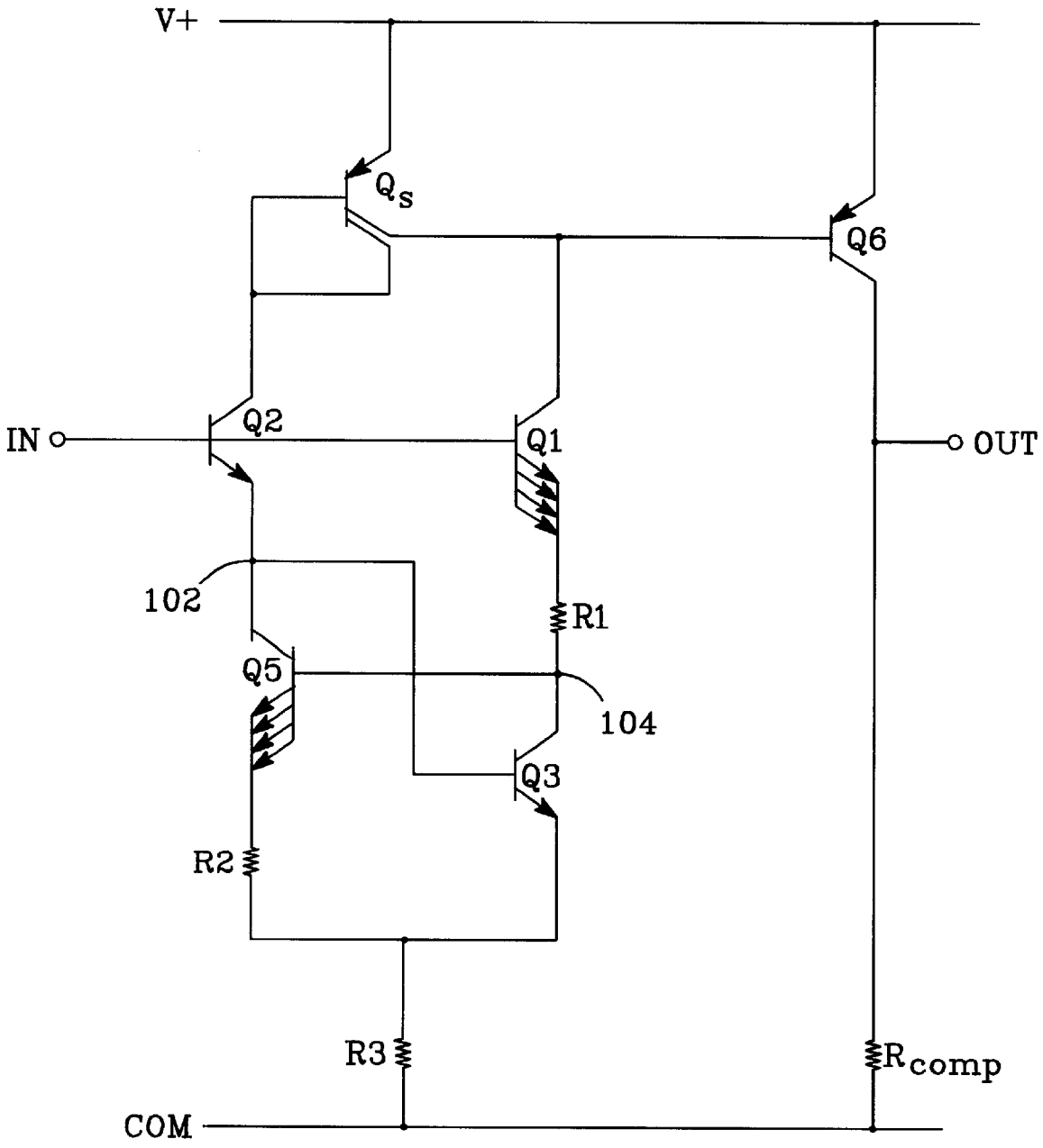
FIG. 4*b* is a schematic diagram of the novel cell configured as a comparator.

A reference cell configured as a comparator is shown in FIG. 4*b*. The circuit is very similar to that of FIG. 4*a*, except that the left and right sides of the quad are reversed, with the collector of Q1 now connected to the base of transistor Q6, and a resistor $R_{comp}$ connected between the comparator's output, i.e., the collector of Q6, and circuit common. The common bases of Q1 and Q2 form an input terminal IN. When a voltage applied to IN is below the equilibrium voltage, most of the cell current flows through Q2. This current is mirrored to the base of Q6, reducing the drive to Q6 to nearly zero. Resistor $R_{comp}$ pulls the output low in this state. When the input exceeds the equilibrium voltage, the cell current switches to the Q1 side of the quad, driving Q6 and producing an output at OUT. R1 should be made greater than R2 to introduce some hysteresis, as described above.

In some applications, an equilibrium voltage that is greater than two bandgap voltages may be desired. This could be obtained with a voltage divider connected between the collector of Q6 and circuit common (referring back to FIG. 4*a*), with the divider tap connected to node 108. $V_{out}$ is scaled to a higher voltage while the loop continues to come to balance when node 108 is at two bandgaps. However, for reasons noted above, the use of a resistive divider may be undesirable.

Figure 5:
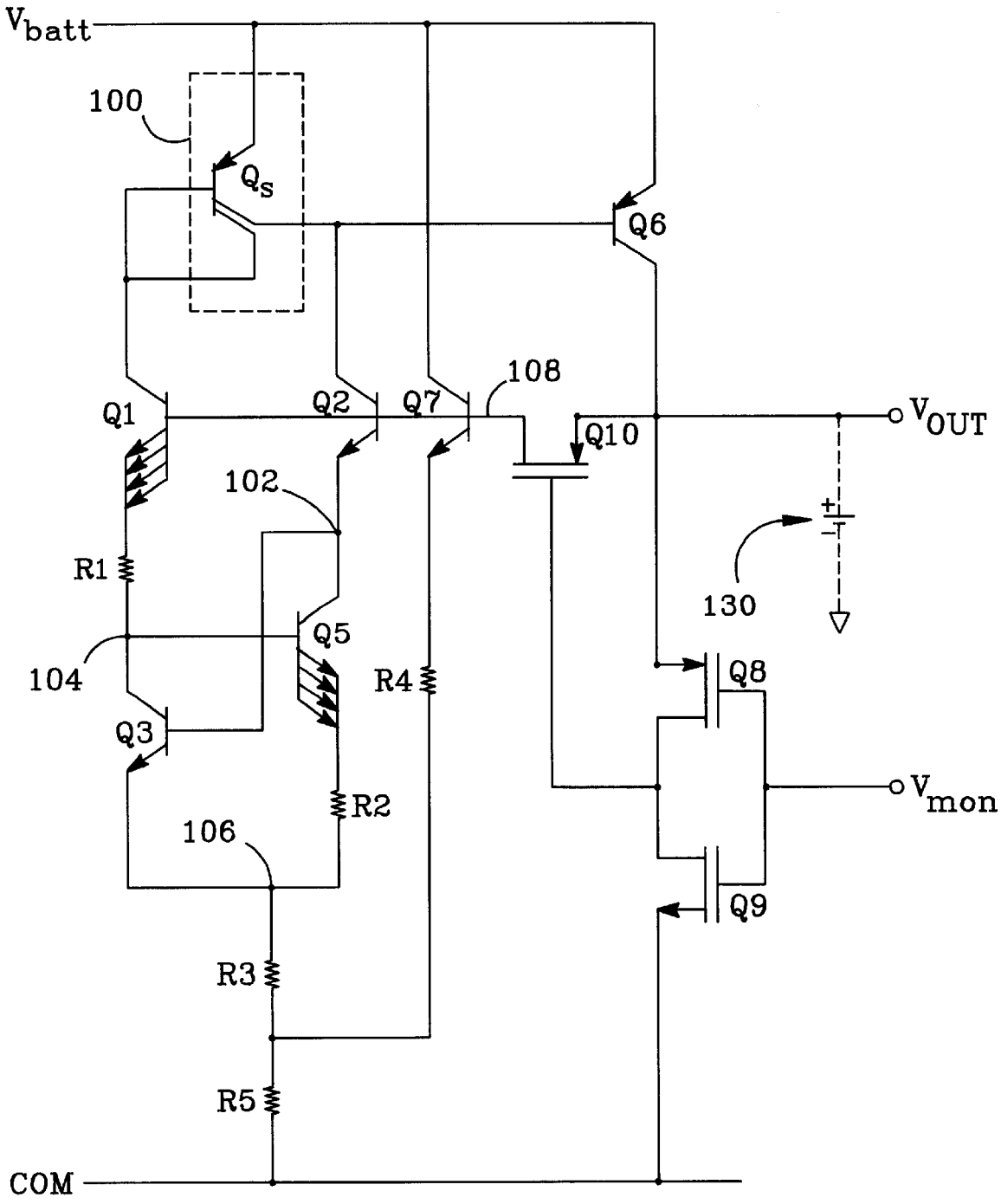
FIG. 5 is a schematic diagram of the novel cell as it might be used in a battery charger application.

A regulator which addresses these problems and is built around the novel bandgap reference cell is shown in FIG. 5. The need to provide an output greater than two bandgaps is met with the addition of a transistor Q7 and a resistor R4. The base of Q7 is connected to input node 108 along with the bases of Q1 and Q2, and its emitter is connected to the bottom of tail resistor R3 at a node 120 via resistor R4. A resistor R5 is interposed between node 120 and circuit common.

When the regulator is in regulation, the voltage from node 108 to node 106 is equal to two base-emitter junctions voltages. Assuming some current in Q7, its emitter will be below node 108 by one base-emitter voltage, or one base-emitter voltage above node 106. R3 and R5 are selected such that, at equilibrium, the PTAT voltage across R3+R5 compensates two base-emitter voltages, so that approximately half of the PTAT voltage compensates a single base-emitter voltage. R3 and R5 are selected so that approximately half the PTAT voltage is at node 120; this compensates Q7 and makes the voltage from the emitter of Q7 to node 120 temperature invariant. Resistor R4 spans this voltage, so that its current is also temperature invariant.

R4's temperature invariant current (at equilibrium) flows in R5, adding to the voltage already present and compensating the quad. Since this additional voltage is constant, it simply offsets the equilibrium point to a higher, temperature stable voltage at node 108. This higher voltage can be adjusted by adjusting R4.

Alternative arrangements for establishing a higher equilibrium voltage are possible. For example, R4 could be connected to node 106 instead of node 120, causing a complementary-to-absolute-temperature (CTAT) voltage to be added to the output. The resulting temperature coefficient could be compensated by adding some resistance in the R3, R5 path to increase the PTAT voltage component, and the values of R4 and R3+R5 could be adjusted together to set the equilibrium voltage at a value higher than two bandgap voltages. Connecting R4 to node 120 is preferred, however, to reduce the interaction between R4 and R3+R5 and thereby facilitate trimming.

The regulator shown in FIG. 5 is advantageously used as a battery charger, to charge a battery 130 connected to $V_{out}$. The circuit shown charges the battery at a relatively high rate if its voltage is below full charge, without exceeding some maximum value when the battery is at a very low voltage. The battery charger is itself powered by a battery with a voltage $V_{batt}$. An inverter is made from transistors Q8 and Q9 and is driven by a signal $V_{mon}$ which monitors the value of $V_{batt}$ with respect to $V_{out}$; $V_{mon}$ is high when $V_{batt}$ is sufficiently greater than $V_{out}$. The output of the inverter controls a transistor Q10 connected between $V_{out}$ and node 108. In normal operation, $V_{batt}$ exceeds $V_{out}$ and $V_{mon}$ is high. The inverter turns on Q10, connecting $V_{out}$ to node 108. However, if $V_{batt}$ becomes discharged, or is removed from the circuit, $V_{mon}$ goes low, turning off Q10 and disconnecting the load battery 130 from node 108. This prevents inadvertent discharge of the load battery 130.

As the node 108 voltage rises, the current that results in R3 and R5 flows mostly through Q2 and Q5 to the base of Q6. A maximum charging current is established by controlling the values of R3 and R5. Voltage $V_{out}$ rises as the battery 130 approaches a fully charged condition; when $V_{out}$ reaches the equilibrium voltage, the cell current switches from the right side to the left side, and the charging current to the battery is reduced to a low "maintenance" level.

The load battery 130 presents a low impedance when near full charge, so that loop stability is unlikely to be a problem. Thus, for this battery charger application, R1 and R2 are preferably made equal to provide the highest possible transconductance. If a higher impedance load were being driven, a lower transconductance may be preferable, which is easily achieved by making R1 smaller than R2.

Though the novel high transconductance reference cell has been described and shown as made from npn bipolar transistors, it is obvious that it can be similarly constructed of pnp transistors (with a corresponding inversion of supply voltage polarity and current flow direction), with no difference in the invention's function or performance advantages.

While particular embodiments of the invention have been shown and described, numerous variations and alternate embodiments will occur to those skilled in the art. Accordingly, it is intended that the invention be limited only in terms of the appended claims.

I claim:

1. A high transconductance voltage reference cell, comprising:

a first transistor pair comprising first and second bipolar transistors having their bases connected together at an input node for receiving an input voltage, a current source connected to supply balanced currents to the collectors of said first and second transistors and which produces an output which varies in accordance with the difference between said collector currents, a second transistor pair comprising third and fourth bipolar transistors connected in a crossed-quad configuration with said first pair with the bases of said third and fourth transistors cross-coupled to the collectors of said fourth and third transistors, respectively, at least one of said transistor pairs having unequal emitter areas, said first and third transistors forming a first side of said cell and said second and fourth transistors forming a second side of said cell, a first resistor R1 connected between the emitter of a transistor of said first pair and the base of a transistor of said second pair, and a second resistor R2 connected between the emitter of one of said transistors of said second pair and a first node, said first node also connected to the emitter of the other transistor of said second pair and to a circuit common point, said cell conducting a cell current from said input node to said common point when an input voltage is applied to said input node, said cell arranged such that most of said cell current flows through one of said sides for input voltages below an equilibrium voltage and through the other of said sides for input voltages above said equilibrium voltage, thereby providing a high transconductance for said cell.

2. The reference cell of claim 1, wherein the cell current is equally divided between the two sides when said input voltage is equal to said equilibrium voltage.

3. The reference cell of claim 1, wherein said equilibrium voltage is established in accordance with the ratio between the emitter areas of said at least one transistor pair having unequal emitter areas.

4. The reference cell of claim 1, wherein the cell current at said equilibrium voltage is a proportional-to-absolute-temperature (PTAT) current.

5. The reference cell of claim 1, wherein said first transistor has an emitter area x times larger than said second transistor and said fourth transistor has an emitter area y times larger than said third transistor.

6. The reference cell of claim 5, wherein R1 is connected to the emitter of said first transistor and carries a current i1 and R2 is connected to the emitter of said fourth transistor and carries a current i2, such that said equilibrium voltage is the voltage at which $(kT/q)\ln(x*y)=i1R1+i2R2$, where k is Boltzmann's constant, q is the magnitude of the electronic charge, and T is the absolute temperature.

7. The reference cell of claim 1, wherein the values of said first and second resistors are about equal to provide said cell with a loop gain of about one and thereby providing a maximum transconductance.

8. The reference cell of claim 1, wherein the ratio of the value of said first resistor to the value of said second resistor is less than one to provide said cell with a loop gain of less than one, thereby providing a transconductance that is less than when said first and second resistor values are equal.

9. The reference cell of claim 1, wherein the ratio of the value of said first resistor to the value of said second resistor is greater than one to provide a loop gain of greater than one, thereby introducing hysteresis around said equilibrium voltage.

10. The reference cell of claim 1, wherein said current source comprises a current mirror connected such that the current supplied to said first transistor is mirrored to said second transistor.

11. The reference cell of claim 10, wherein said current mirror comprises a dual-collector transistor having a first collector diode-connected and supplying current to said first transistor and a second collector supplying current to said second transistor.

12. The reference cell of claim 1, wherein said second resistor is connected between said first node and the emitter of the transistor of said second pair which is on the opposite side of said cell from the emitter of said transistor of said first pair to which said first resistor is connected.

13. A high transconductance voltage reference cell, comprising:

a first transistor pair comprising first and second bipolar transistors having their bases connected together at an input node for receiving an input voltage, a current source connected to supply balanced currents to the collectors of said first and second transistors and which produces an output which varies in accordance with the difference between said collector currents, a second transistor pair comprising third and fourth bipolar transistors connected in a crossed-quad configuration with said first pair with the bases of said third and fourth transistors cross-coupled to the collectors of said fourth and third transistors, respectively, at least one of said transistor pairs having unequal emitter areas, said first and third transistors forming a first side of said cell and said second and fourth transistors forming a second side of said cell, a first resistor R1 connected between the emitter of a transistor of said first pair and the base of a transistor of said second pair, a second resistor R2 connected between the emitter of one of said transistors of said second pair and a first node, said first node also connected to the emitter of the other transistor of said second pair and to a circuit common point, and a pass transistor having a control input connected to said output, an emitter connected to a supply voltage, and a collector connected to said input node, said cell conducting a cell current from said input node to said common point when an input voltage is applied to said input node, said cell arranged such that most of said cell current flows through one of said sides for input voltages below an equilibrium voltage and through the other of said sides for input voltages above said equilibrium voltage, thereby providing a high transconductance for said cell, said cell producing a drive current to said pass transistor equal to nearly all of said cell current when the voltage at said input node is below said equilibrium voltage and reducing said drive current to about zero when the voltage at said input node exceeds said equilibrium voltage.

14. The reference cell of claim 13, wherein said current source comprises a current mirror connected such that the current supplied to said first transistor is mirrored to said second transistor so that the drive current to said pass transistor is about equal to the mirrored current minus the collector current of said second transistor.

15. The reference cell of claim 1, further comprising a third resistor connected between said first node and said circuit common point which, when said input node is at said equilibrium voltage, provides a proportional-to-absolute-temperature (PTAT) voltage at said first node which compensates the base-emitter junction voltages of the transistors of said first and second pairs which do not have resistors connected in series with their respective emitters and thereby provides a double bandgap voltage at said input node.

16. The reference cell of claim 1, further comprising third and fourth resistors connected together at a second node and series-connected between said first node and said circuit common which, when said input node is at said equilibrium voltage, provides a PTAT voltage at said first node which compensates the base-emitter junction voltages of the transistors of said first and second pairs which do not have resistors connected in series with their respective emitters and thereby provides a double bandgap voltage at said input node, and further comprising a fifth bipolar transistor and a fifth resistor, said fifth transistor connected at its base to said input node and said fifth resistor connected between the emitter of said fifth transistor and said second node, said third and fourth resistors selected so that the voltage at said second node is equal to about half of said PTAT voltage which compensates said fifth transistor to create a temperature invariant current in said fifth resistor which flows in said fourth resistor to offset said equilibrium voltage to a higher, temperature stable voltage in accordance with the value of said fifth resistor.

17. A high transconductance bandgap reference cell, comprising:

a first transistor pair comprising first and second bipolar transistors having their bases connected together at an input node for receiving an input voltage, said first and second transistors having unequal emitter areas, a current mirror connected to mirror the collector current of said first transistor to said second transistor and thereby producing an output about equal to said mirrored current minus said second transistor's collector current at said second transistor's collector, a second transistor pair comprising third and fourth bipolar transistors connected in a crossed-quad configuration with said first pair with the bases of said third and fourth transistors cross-coupled to the collectors of said fourth and third transistors, respectively, said third and fourth transistors having unequal emitter areas, said first and third transistors forming a first side of said cell and said second and fourth transistors forming a second side of said cell, a first resistor connected between the emitter of the transistor of said first pair having the larger emitter area and the base of the transistor of said second pair having the larger emitter area, a second resistor connected between the emitter of the transistor of said second pair having the larger emitter area and a first node, said first node also connected to the emitter of the other transistor of said second pair, and a third resistor connected between said first node and a circuit common point, said cell conducting a cell current from said input node to said common point when an input voltage is applied to said input node, said cell arranged such that most of said cell current flows through one of said sides for input voltages below an equilibrium voltage and through the other of said sides for input voltages above said equilibrium voltage, thereby providing a high transconductance for said cell.

18. The bandgap reference cell of claim 17, wherein the current through said third resistor when said input node is at said equilibrium voltage provides a proportional-to-absolute-temperature (PTAT) voltage at said first node which compensates the base-emitter junction voltages of the transistors of said first and second pairs which do not have resistors connected in series with their respective emitters and thereby provides a double bandgap voltage at said input node.

19. A high transconductance bandgap reference cell, comprising:

a first transistor pair comprising first and second bipolar transistors having their bases connected together at an input node for receiving an input voltage, said first and second transistors having unequal emitter areas, a current mirror connected to mirror the collector current of said first transistor to said second transistor and thereby producing an output about equal to said mirrored current minus said second transistor's collector current at said second transistor's collector, a second transistor pair comprising third and fourth bipolar transistors connected in a crossed-quad configuration with said first pair with the bases of said third and fourth transistors cross-coupled to the collectors of said fourth and third transistors, respectively, said third and fourth transistors having unequal emitter areas, said first and third transistors forming a first side of said cell and said second and fourth transistors forming a second side of said cell, a first resistor connected between the emitter of the transistor of said first pair having the larger emitter area and the base of the transistor of said second pair having the larger emitter area, a second resistor connected between the emitter of the transistor of said second pair having the larger emitter area and a first node, said first node also connected to the emitter of the other transistor of said second pair, a third resistor connected between said first node and a circuit common point, and a pass transistor having its base connected to said cell output, its emitter connected to a supply voltage, and its collector connected to said input node, said cell conducting a cell current from said input node to said common point when an input voltage is applied to said input node, said cell arranged such that most of said cell current flows through one of said sides for input voltages below an equilibrium voltage and through the other of said sides for input voltages above said equilibrium voltage, thereby providing a high transconductance for said cell, wherein the current through said third resistor when said input node is at said equilibrium voltage provides a proportional-to-absolute-temperature (PTAT) voltage at said first node which compensates the base-emitter junction voltages of the transistors of said first and second pairs which do not have resistors in their respective emitter circuits and thereby provides a double bandgap voltage at said input node.

20. The bandgap reference cell of claim 19, wherein said resistors are selected to limit the current that can be delivered to the base of said pass transistor to a predetermined maximum value.

21. A battery charger, comprising:

a high transconductance bandgap reference cell, comprising:

a first transistor pair comprising first and second bipolar transistors having their bases connected together at an input node, a current source connected to supply balanced currents to the collectors of said first and second transistors and which produces an output which varies in accordance with the difference between said collector currents, a second transistor pair comprising third and fourth bipolar transistors connected in a crossed-quad configuration with said first pair with the bases of said third and fourth transistors cross-coupled to the collectors of said fourth and third transistors, respectively, at least one of said transistor pairs having unequal emitter areas, said first and third transistors forming a first side of said cell and said second and fourth transistors forming a second side of said cell, a first resistor connected between the emitter of a transistor of said first pair and the base of a transistor of said second pair, a second resistor connected between the emitter of a transistor of said second pair and a circuit common point, said cell conducting a cell current from said input node to said common point when an input voltage is applied to said input node, said cell arranged such that most of said cell current flows through one of said sides for input voltages below a predetermined equilibrium voltage and through the other of said sides for input voltages above said equilibrium voltage, thereby providing a high transconductance for said cell, and a pass transistor having its base connected to said cell output, its emitter connected to a supply voltage, and its collector connected to said input node, said battery charger arranged to provide a charging current to a battery connected to said pass transistor collector when said input voltage is below said equilibrium voltage and reducing said charging current when said input voltage exceeds said equilibrium voltage.

22. The battery charger of claim 21, further comprising a battery connected to the collector of said pass transistor.

23. The battery charger of claim 21, wherein said battery charger is powered by said supply voltage and further comprising a circuit arranged to disconnect said pass transistor's collector from said input node when said supply voltage is below a predetermined threshold.

* * * * *